United States Patent [19]

Carter

[11] Patent Number: 4,465,613

[45] Date of Patent: Aug. 14, 1984

[54] ALKYL PHOSPHORIC SALT-HYDROCARBON WAX LATHER CONTROLLED DETERGENT COMPOSITIONS

[75] Inventor: Malcolm N. A. Carter, Merseyside, England

[73] Assignee: Lever Brothers Company, New York, N.Y.

[21] Appl. No.: 205,040

[22] Filed: Nov. 7, 1980

Related U.S. Application Data

[63] Continuation of Ser. No. 055,138, Jul. 5, 1979, abandoned, which is a continuation of Ser. No. 757,164, Jan. 6, 1977, abandoned.

[30] Foreign Application Priority Data

Jan. 23, 1976 [GB] United Kingdom ..... 266976

[51] Int. Cl.[3] ..... C11D 3/36; C11D 11/00

[52] U.S. Cl. ..... 252/174.16; 252/135; 252/321; 252/351; 252/539; 252/540; 252/DIG. 17

[58] Field of Search ..... 252/132, 135, 140, 155, 252/174.16, 321, 358, 539, 540, DIG. 17

[56] References Cited

U.S. PATENT DOCUMENTS

| | | |
|---|---|---|
| 3,277,217 | 10/1966 | Nehmsmann et al. . |
| 3,314,891 | 4/1967 | Schmolka et al. . |
| 3,399,144 | 6/1968 | Hathaway et al. . |
| 3,523,902 | 8/1970 | Schmolka . |
| 3,738,943 | 6/1973 | Kaneko . |
| 3,770,855 | 11/1973 | Benson et al. . |
| 3,869,412 | 3/1975 | Waag . |
| 3,957,661 | 5/1976 | Verite . |
| 4,056,481 | 11/1977 | Tate . |
| 4,070,298 | 1/1978 | Scarderva . |

FOREIGN PATENT DOCUMENTS

| | | |
|---|---|---|
| 17604394 | 3/1976 | Netherlands . |
| 1300829 | 12/1972 | United Kingdom . |

*Primary Examiner*—P. E. Willis, Jr.

*Attorney, Agent, or Firm*—Milton L. Honig; James J. Farrell

[57] ABSTRACT

Mixed lather controllers comprise a $C_{12}$–$C_{24}$ alkyl phosphoric acid or salt thereof together with a solid hydrocarbon wax having a melting point of 20°–120° C. The use of these mixed lather controllers is especially beneficial in built fabric washing detergent compositions.

21 Claims, No Drawings

ALKYL PHOSPHORIC SALT-HYDROCARBON WAX LATHER CONTROLLED DETERGENT COMPOSITIONS

This application is a continuation of application Ser. No. 055,138, filed July 5, 1979, now abandoned, which in turn is a continuation of application Ser. No. 757,164, filed Jan. 6, 1977, now abandoned.

The invention relates to detergent compositions, and in particular to detergent compositions adapted for fabric washing.

It is an important requirement of detergent compositions in general that they should exhibit appropriate lather or sudsing properties, dependent on the particular conditions of use expected for those compositions. Some detergent compositions, especially those intended for hand washing use at relatively low temperatures should generally be able to produce a copious lather at such temperatures. However, detergent compositions for use in many automatic washing machines should generally speaking have fairly low lather properties, as otherwise excessive lathering can cause overflowing from the machines. But the total suppression of lather is generally not desirable, as the consumer often assesses product performance and product dosing amounts by the lather level.

Many methods of controlling the lather in detergent compositions, especially in detergent compositions for fabric washing, have been proposed hitherto. Perhaps the most common system in present commercial practice is the use of special so-called mixed ternary detergent active systems, which most commonly comprise a synthetic anionic detergent compound, a nonionic detergent compound and a soap, especially a soap of a long chain fatty acid, ie about $C_{18}$–$C_{24}$. However, these systems often do not give the ideal lather performance which would be desired, for example they may tend to suppress the lather at lower rather than high temperatures, and they tend to be relatively expensive. Moreover, production of such compositions can be inconvenient as they have to be made entirely separately from other types of detergent compositions. It would clearly be preferable to have an efficient and economical lather control system for detergent compositions which could be used very simply by adding it to standard detergent base formulations so as to convert otherwise high sudsing compositions into controlled low sudsing compositions.

It has been proposed to use several lather controlling additives in detergent compositions, but none of those suggested has been wholly acceptable so far. For example, silicones tend to be very expensive and they can be difficult to incorporate into detergent compositions in such a manner as to retain full lather control properties. Alternatively, alkyl phosphoric acids and their alkali metal salts have been proposed for use as lather controllers, but they tend to give variable performance depending on the conditions of use, and are relatively ineffective with high sudsing detergent active compounds such as alkyl benzene sulphonates or alkyl sulphonates except at impracticable or uneconomic levels.

According to the present invention, a detergent composition comprises as combined lather controllers both an alkyl phosphoric acid or a salt thereof and a wax. The combinations of the alkyl phosphoric acid or salt and the wax as described more fully below, are relatively economical and give efficient lather control properties during use.

The alkyl phosphoric acids which are used, optionally in salt form, have the following general formula:

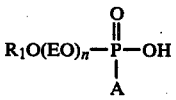

(I)

Where A is —OH or $R_2O(EO)_m$—, $R_1$ and $R_2$ are the same or different $C_{12}$–$C_{24}$, preferably $C_{16}$–$C_{22}$, straight or branched chain, saturated or unsaturated alkyl groups, especially $C_{16}$–$C_{18}$ linear saturated groups, and m and n are the same or different and are 0 or an integer of from 1 to 6. Preferably A is —OH and n is 0, so that the compounds are the monoalkyl phosphoric acids, preferably with linear alkyl groups. If any ethylene oxide (EO) groups are present in the alkyl phosphoric acids, they should not be too long in relation to the alkyl chain length to make the calcium or magnesium salts soluble in water during use.

In practice, the alkyl phosphate compounds are commonly mixtures of both mono- and di-alkyl phosphoric acids, with a range of alkyl chain lengths. Predominantly monoalkyl phosphates are usually made by phosphorylation of alcohols or ethoxylated alcohols, when n or m is 1 to 6, using a polyphosphoric acid. Phosphorylation may alternatively be accomplished using phosphorus pentoxide, in which case the mixed mono- and di-alkyl phosphates are produced. Under optimum reaction conditions only small quantities of unreacted materials or byproducts are produced, and the reaction products can advantageously be used directly in the detergent compositions.

The substituted phosphoric acids of formula (I) above are used as stated in acid or salt form, that is either as the partial or preferably full salt. When the alkyl phosphoric acid is added to the detergent composition in acid form, it will of course be neutralised, usually to form the sodium salt, when the detergent composition is in aqueous alkaline solution. On use of the composition in hard water, the insoluble calcium or magnesium salt is then formed, but in soft water some of the alkyl phosphate may remain in alkali metal, usually sodium, salt form. If the alkyl phosphate is added to the composition in alkali metal or ammonium salt form, then again the calcium and/or mangesium salt is formed on use in hard water.

It is, however, preferred to use a preformed insoluble alkyl phosphoric acid salt, with a polyvalent cation which is preferably calcium, though aluminium, barium, zinc, magnesium or strontium salts may alternatively be used. Mixtures of the insoluble alkyl phosphoric acid salts with the free acid or other soluble, eg alkali metal salts may also be used if desired. The preferred insoluble alkyl phosphoric acid salts need not be totally insoluble in the detergent systems, but they should be sufficiently insoluble that undissolved solid salt is present in the detergent systems during use, as this appears to be necessary for effective lather control.

The insoluble alkyl phosphoric acid salts can be added to the detergent compositions in a preformed condition or they can be precipitated during the actual production of the detergent composition itself, for example in a detergent slurry making process. In either case, however, it is preferred that the alkyl phosphoric acid salts should be in finely divided particulate form in the product and readily dispersible throughout the wash liquor in use. It is preferred to have an average particle size of about 0.1–25μ, with a maximum particle size of not more than about 50μ, though it is possible to use initially larger particles of the alkyl phosphate salts provided they are broken down during processing.

The use of the insoluble alkyl phosphoric acid salts for lather control purposes is described and claimed in the specification of our copending U.S. patent application No. 280,973 of even date, U.S. Pat. No. 4,362,642.

The amount of the alkyl phosphoric acid or salt thereof used in the detergent compositions can be varied widely from a minimum level of about 0.05% up to a practical maximum of about 20%, preferably about 0.1% to about 5% by weight. Higher levels than 20% can be employed but this would be uneconomical and would generally not give any product advantages.

Suitable hydrocarbon waxes for use in the detergent compositions are water insoluble materials of either synthetic, mineral, vegetable or animal origin, which are dispersible in the detergent solutions. The waxes should normally melt at a temperature between about 20° C. and about 120° C., preferably not more than about 90° C. and especially in the range of about 30° C. to about 70° C., ie lower than the maximum intended wash temperatures for the detergent compositions. When waxes having melting points above the maximum intended wash temperatures are used they should be adequately dispersed in the wash liquor by suitable incorporation in the original detergent compositions.

The preferred waxes are of mineral origin, especially those derived from petroleum, including microcrystalline and oxidised microcrystalline petroleum waxes, petroleum jelly ("Vaseline") and paraffin waxes. Petroleum jelly is correctly a semi-solid wax, usually having a mp about 30°–40° C., but is for convenience here grouped with other solid waxes. Synthetic waxes such as Fischer-Tropsch and oxidised Fischer-Tropsch waxes, or Montan waxes, or natural waxes such as beeswax, candelilla and carnauba waxes may be used if desired. Any of the waxes described may be used alone or in admixture with other waxes. The waxes should be readily dispersible in the detergent liquor but not soluble therein, and preferably they should not have very high saponification values, eg not in excess of about 100. It is advantageous to include emulsifying or stabilising agents for the waxes in the detergent compositions.

The amount of wax is normally from about 0.05% to about 20%, preferably about 0.1% to about 10% and especially about 0.5% to about 5% in the composition. The total amount of the alkyl phosphoric acid or salt and the hydrocarbon wax is generally from about 0.2% to about 20% by weight of the composition, preferably about 0.5% to about 10% by weight. The ratio of the amount of the alkyl phosphoric acid or salt to the wax can be varied widely from about 1:250 to about 10:1 parts by weight but is generally from about 1:20 to about 10:1 parts by weight, preferably from about 1:10 to about 1:1 parts by weight.

It should be noted that the hydrocarbon waxes have a beneficial effect on the lather control properties of the detergent compositions. The waxes do not alone have satisfactory lather control properties at the relatively low levels usually used, but they appear to act synergistically with the alkyl phosphoric acids or salts thereof to give improved lather control at lower levels of the salts than would otherwise be required, besides changing the lather profiles during use, depending on the specific waxes used and the methods of incorporation into the compositions, usually to give greater lather control at higher wash temperatures.

The alkyl phosphoric acids or salts and the hydrocarbon waxes may be added separately to the detergent composition, either to the finished products or during detergent processing, for example by admixture in a slurry prior to spray drying. However, it is preferred to add the waxes and the alkyl phosphoric acids or salts together in substantially homogeneous admixture. This additive mixture may be sprayed in melt form onto powdered detergent compositions, or it may be made in granular form for admixture with powdered detergent compositions. Granulation of the detergent additive may be accomplished readily, for example by extrusion processes to form noodles or by mixing techniques, for example in pan granulators. Granulation may also be aided by adding fillers which preferably also have detergent properties, for example sodium carbonate, sodium perborate mono- or tetra-hydrate or sodium tripolyphosphate.

One aspect of the present invention is the provision of the detergent additives themselves, which comprise an alkyl phosphoric acid or a salt thereof of formula (I) above, together with a solid hydrocarbon wax is substantially homogeneous admixture, and processes for the production of detergent compositions using the additives. It will be appreciated that these detergent additives can be used in detergent compositions intended for purposes other than fabric washing, for example in dishwashing detergent products or for other purposes where lather suppression is desirable.

In addition to the wax which is used with the alkyl phosphoric acid or salt in the detergent composition, a hydrocarbon oil may also be present, either added separately or jointly with the wax, for example in order to facilitate addition of the wax or to modify its melting point or dispersion characteristics.

Examples of suitable liquid hydrocarbons are mineral, vegetable or animal oils of which colourless mineral oils are preferred. Either light or heavy mineral oil or mixtures thereof may be employed, but of course any liquid hydrocarbon used must be of low volatility at normal fabric washing temperatures. Other oils which could be used if desired are vegetable oils such as sesame oil, cotton seed oil, corn oil, sweet almond oil, olive oil, wheat germ oil, rice bran oil, or peanut oil, or animal oils such as lanolin, neat's foot oil, bone oil, sperm oil or cod liver oil. Any such oils used should of course not be highly coloured, of strong odour or otherwise unacceptable for use in a detergent composition.

The detergent compositions of the invention essentially include one or more detergent compounds which may be anionic, soap or non-soap, nonionic, zwitterionic or amphoteric in nature. Many suitable detergent compounds are commercially available and they are fully described in the literature, for example in "Surface Active Agents and Detergents", Volumes I and II, by Schwartz, Perry & Berch.

Specific preferred detergent compounds which may be mentioned are synthetic anionic detergent compounds, which are usually water soluble alkali metal salts of organic sulphates and sulphonates having alkyl radicals containing from about 8 to 22 carbon atoms, the term alkyl being used to include the alkyl portion of higher acyl radicals. Examples of suitable synthetic anionic detergent compounds are sodium and potassium alkyl sulphates, especially those obtained by sulphating the higher ($C_8$–$C_{18}$) alcohols produced by reducing the glycerides of tallow or coconut oil; sodium and potassium alkyl ($C_9$–$C_{20}$) benzene sulphonates, particularly sodium linear secondary alkyl ($C_{10}$–$C_{15}$) benzene sulphonates; sodium alkyl glyceryl ether sulphates, especially those ethers of the higher alcohols derived from tallow or coconut oil and synthetic alcohols derived from petroleum; sodium coconut oil fatty acid monoglyceride sulphates and sulphonates; sodium and potassium salts of sulphuric acid esters of higher ($C_9$–$C_{18}$) fatty alcohol-alkylene oxide, particularly ethylene oxide, reaction products; the reaction products of fatty acids such as coconut fatty acids esterified with isethionic acid and neutralised with sodium hydroxide; sodium and potassium salts of fatty acid amides of methyl taurine; alkane monosulphonates such as those derived by reacting alpha-olefins ($C_8$–$C_{20}$) with sodium bisulphite and those derived by reacting paraffins with $SO_2$ and $Cl_2$ and then hydrolysing with a base to produce a random sulphonate; and olefin sulphonates, which term is used to describe the material made by reacting olefins, particularly alpha-olefins, with $SO_3$ and then neutralising and hydrolysing the reaction product.

If desired, nonionic detergent active compounds may alternatively or additionally be used. Examples of nonionic detergent compounds include the reaction products of alkylene oxides, usually ethylene oxide, with alkyl ($C_6$–$C_{22}$) phenols, generally 5 to 25 EO; ie 5 to 25 units of ethylene oxide per molecule; the condensation products of aliphatic ($C_8$–$C_{18}$) primary or secondary alcohols with ethylene oxide, generally 6 to 30 EO, and products made by the condensation of ethylene oxide with the reaction products of propylene oxide and ethylenediamine. Other so-called nonionic detergent active compounds include long chain tertiary amine oxides, long chain tertiary phosphine oxides and dialkyl sulphoxides, which are properly semi-polar compounds.

Mixtures of detergent active compounds, for example mixed anionic or mixed anionic and nonionic compounds may be used in the detergent compositions, if desired.

Amounts of amphoteric or zwitterionic, eg sulphobetaine detergent compounds, can also be used in the compositions of the invention but this is not normally desired due to their relatively high cost. If any amphoteric or zwitterionic detergent active compounds are used, it is generally in small amounts in compositions based on the much more commonly used anionic and/or nonionic detergent compounds for example mixtures of nonionic compounds and sulphobetaines. Likewise, low levels of cationic compounds may be used but only in conjunction with larger amount of other detergent compounds.

The amount of the detergent compound or compounds used may be varied widely, normally from a minimum of about 1% up to a maximum of about 90% by weight, depending on the type of detergent composition concerned. However, in the case of the preferred detergent compositions for fabric washing purposes, the amount of the detergent compounds is generally in the range from about 5% to about 50% by weight, preferably about 7% to about 20% by weight.

It is also preferred to include a detergency builder in the detergent compositions of the invention, especially in such compositions which are adapted for fabric washing. The detergency builders function to decrease the calcium ion concentration in wash liquor, usually either by sequestering the hard water ions present or by forming insoluble salts with the calcium and/or magnesium ions. Several suitable detergency builders are well known and commercially available, whilst many more have been described in the literature, especially in recent patent specifications on replacements for the conventional condensed phosphate builders such as sodium tripolyphosphate and sodium pyrophosphate. Other detergency builders which may be mentioned by way of example, are alkali metal carbonates and orthophosphates, especially sodium carbonate and trisodium orthophosphate, alkali metal polyphosphonates, eg sodium ethane-1-hydroxy-1,1-diphosphonate, alkali metal amine carboxylates, such as sodium nitrilotriacetate and sodium ethylenediamine tetraacetate, alkali metal ether carboxylates, such as sodium oxydiacetate, sodium carboxymethyloxysuccinate, sodium carboxymethyloxymalonate and homologues thereof, alkali metal citrates, alkali metal mellitates, and salts of polymeric carboxylic acids, such as sodium polymaleate, copolyethylenemaleate, polyitaconate and polyacrylate. When sodium carbonate is used as a detergency builder, it is advantageous to have present some calcium carbonate having a surface area of at least about 10 $m^2/g$, as described in UK Pat. No. 1,437,950.

Another type of detergency builder which can be used, either alone or in admixture with other builders, is a cation exchange material, especially a sodium aluminosilicate such as described in UK Pat. No. 1,429,143 or in Netherlands patent application No. 7403381. Preferred materials of this type have the formula:

$$(Na_2O)_{0.7-1.1}.Al_2O_3.(SiO_2)_{1.3-3.3}$$

and may be amorphous or crystalline, with some bound water usually in an amount of about 10–30% depending on the drying conditions used. Such sodium aluminosilicate materials should, of course, be very finely divided so as to minimise deposition on the fabrics during washing.

The amount of the detergency builder which is used is normally from about 5% up to about 80% by weight of the composition, preferably about 10% to about 60%, and the ratio by weight of the detergency builders to the detergent active compounds which are used is generally from about 10:1 to about 1:5 parts by weight.

The lather controlling properties of the present invention are particularly beneficial with built fabric washing detergent compositions based on anionic detergent compounds, which otherwise tend to be high sudsing with difficult lather control problems.

The detergent compositions of the invention may take any of the usual physical forms, preferably as solid compositions, for example as powders, granules, flakes, ribbons, noodles or tablets, or they may be in liquid or paste form. The detergent compositions may also be made by any of the conventional processes for making detergent compositions, especially by the technique of slurry making and spray drying in the case of the preferred powdered detergent compositions.

The detergent compositions of the invention may also include any of the conventional optional additives in the amounts usually employed in detergent compositions. Examples of these additives include powder flow aids such as finely divided silicas and aluminosilicates, other lather controllers, antiredeposition agents such as sodium carboxymethylcellulose, oxygen-releasing bleaching agents such as sodium perborate and sodium percarbonate, per-acid bleach precursors such as tetraacetylethylenediamine, chlorine-releasing bleaching agents such as trichloroisocyanuric acid and alkali metal salts of dichloroisocyanuric acid, fabric softening agents such as clays of the smectite and illite types, anti-ashing aids, starches, slurry stabilisers such as copolyethylene-maleic anhydride and copolyvinylmethylether-maleic anhydride, usually in salt form, inorganic salts such as sodium silicates and sodium sulphate, and usually present in very minor amounts, fluorescent agents, perfumes, enzymes such as proteases and amylases, germicides and colourants. Dispersing aids and emulsifying agents may also be present if desired, to facilitate dispersion of the alkyl phosphoric acid or salt in the detergent compositions, or in the hydrocarbon wax to form the separate detergent additives. The detergent compositions usually have an alkaline pH, generally in the region of pH 9-11, which is achieved by the presence of alkaline salts especially sodium silicates such as the meta-, neutral or alkaline silicates, preferably at levels up to about 15% by weight.

The invention is illustrated by the following Examples in which parts and percentages are by weight except where otherwise indicated.

EXAMPLES 1 TO 3

A predominantly monoalkyl ($C_{16}$–$C_{18}$) phosphoric acid was dispersed in each of three paraffin waxes having melting points of 41° C., 45° C. and 55° C. and in the ratio 20:80. The lather suppressing properties of these three mixtures were then determined in a Miele 429 automatic washing machine used to wash a 5 lb soiled laundry load using 100 g of detergent composition of the following formulation with 5 g of each of the anti-foam additives in 24°H (French) hard water.

| Ingredient | % |
|---|---|
| Sodium alkyl benzene sulphonate | 14.0 |
| Sodium tripolyphosphate | 33.0 |
| Sodium alkaline silicate | 8.5 |
| Sodium sulphate | 15.3 |
| Sodium perborate | 19.2 |
| Water and minor additives | 10.0 |

The lather level was assessed throughout the main wash cycle on a scale of 0 (lather at bottom window level) up to 1.0 (lather at top window level), with the following results.

| Example | Paraffin Wax | Maximum lather height |
|---|---|---|
| 1 | 41° C. mp | 0.5 |
| 2 | 45° C. mp | 0.5 |
| 3 | 55° C. mp | 0.6 |

The lather levels in each of these tests declined to less than 0 after 10–12 minutes when the temperature exceeded the mps of the waxes. In a comparative test with a hydrocarbon oil instead of the waxes, the maximum lather height after 5 minutes was lower (about 0.2), after which the lather level declined but then rose again as the temperature increased towards the end of the wash cycle at 95° C.

Similar results were achieved to those for Example 1, when the alkyl phosphoric acid+wax mixture was formed into granules by melting the wax mixture and then adding sodium tripolyphosphate and allowing the mixture to cool with stiring (ratio of alkyl phosphoric acid to wax to sodium tripolyphosphate, 5:20:70).

EXAMPLES 4 to 7

The procedure of Examples 1 to 3 was repeated except for the use of petroleum jelly and three microcrystalline waxes, and different processing methods were used to form the detergent compositions. The results for the different waxes were as follows:

| Example | Wax | Maximum Lather Volume |
|---|---|---|
| 4 | Petroleum jelly[1] | <0 throughout wash up to 95° C. |
| 5 | Mobil Wax 2360 (mp 66° C.)[2] | 0.3 (at the end of the wash cycle) |
| 6 | Mobil Wax Cerese (mp 82° C.)[2] | 0.4 after 10 minutes (50° C.) decreasing to <0 |
| 7 | Shell Wax 185/190 (mp 85–88° C.)[2] | between 0.2 and 0.3 throughout most of the wash cycle up to 95° C. |

[1]The alkyl phosphoric acid and wax were mixed and then cooled with stirring to form a granular product and added to the detergent composition.
[2]The alkyl phosphoric acid and wax were melted and sprayed onto the base detergent formulation.

EXAMPLES 8 and 9

The procedures of Examples 1 and 4 were repeated except that the alkyl phosphoric acid was replaced in each case by calcium alkyl phosphate made by neutralizing the alkyl phosphoric acid with sodium hydroxide and then precipitation of the calcium salt by addition of calcium chloride. It was found using the petroleum jelly (Example 8) that the lather volume again increased gradually but the maximum foam level reached was only about 0.25 at the end of the wash cycle. In Example 9 when using the paraffin wax having a higher melting point (41° C.), a peak in lather volume of about 0.75 was reached after 5 minutes in the wash cycle then the lather collapsed and remained generally constant at about a level of about 0.2.

EXAMPLE 10

A detergent composition was prepared as shown below, all the ingredients being added to the detergent slurry during its production:

| Ingredient | Parts (dry basis) |
|---|---|
| Sodium alkyl benzene sulphonate | 14 |
| Calcium alkyl phosphate[1] | 1 |
| Petroleum jelly | 4 |
| Sodium tripolyphosphate | 33 |
| Sodium alkaline silicate | 6 |
| Sodium sulphate | 20.3 |
| Minor ingredients | 0.6 |

[1]The calcium alkyl phosphate was formed in the detergent slurry by reaction between alkyl phosphoric acid (as in Example 1) and calcium chloride.

The detergent composition was used to wash clothes in a Miele 429 automatic washing machine using the procedure described for Examples 1 to 3, except that the amount of the detergent composition used was 78.9 gm (dry basis) and that hard water (24°H) was used. The lather was found to increase progressively throughout the wash cycle but reached the acceptable level of only 0.5, ie half full by the end of the wash cycle. Without the lather controlling ingredients present, the lather was found to overflow severely within a few minutes of washing commencing.

EXAMPLES 11 and 12

Two granular detergent additives were made by melting together 1 part $C_{16}$–$C_{18}$ monoalkyl phosphoric acid or its calcium salt and 4 parts of petroleum jelly and then admixing the melt at 80° C. with 19:2 parts of sodium perborate tetrahydrate in an inclined pan. The resultant granular additives were then added to 80.8 parts of a detergent base formulation of the formula:

| Ingredient | Parts |
|---|---|
| Sodium alkyl benzene sulphonate | 14.0 |
| Sodium tripolyphosphate | 33.0 |
| Sodium alkaline silicate | 8.5 |
| Sodium sulphate | 15.3 |
| Sodium carboxymethylcellulose | 0.5 |
| Sodium ethylenediaminetetraacetate | 0.1 |
| Water | 9.4 |

The lather properties of the resultant compositions were then evaluated in a Miele 429 washing machine, when it was found that very little lather was generated throughout the wash cycle. When other high melting waxes were used instead of the petroleum jelly, initially high lathers were observed but these were controlled as the temperature rose toward the melting points. Similar satisfactory results were obtained when the melt of the calcium alkyl phosphate and petroleum jelly were sprayed directly onto the detergent base powder plus the sodium perborate. A paraffin wax melting at 110° F. was also used successfully in replacement for the petroleum jelly.

EXAMPLES 13 and 14

A homogeneous mixture was prepared of 1 part of the calcium salt of a commercial mixture of predominantly monoalkyl $C_{16}$–$C_{18}$ phosphoric acid and 4 parts of petroleum jelly. 5 gms of the mixture was then added with thorough mixing to 200 gms of a commercially available soap powder and to 80 gms of a commercially available liquid fabric washing detergent product. Both products were used to wash a 5 lb load of soiled clothes in a Miele 429 washing machine at 95° C. in 24°H water. In both cases it was found that the lather level was controlled satisfactorily throughout the wash cycle. But when the original high sudsing soap powder and liquid detergent product were used the lather rose rapidly and overflowing started within about 10 minutes. Similar results were achieved when the calcium alkyl phosphate was replaced by the corresponding alkyl phosphoric acid.

EXAMPLES 15 and 16

Two detergent compositions were prepared to the same formulations of Examples 11 and 12, except that the calcium alkyl phosphate was replaced by the calcium salt of predominantly monoalkyl ($C_{16}$–$C_{18}$)—3 EO phosphoric acid or the corresponding alkyl ether phosphoric acid itself. The compositions were then used in a Miele 429 automatic washing machine to wash a 5 lb soiled load in 24°H water. The lather levels remained low throughout the wash cycle, reaching a maximum level of about one third full and one half full, respectively (as measured in Examples 1 to 3). Similar results were achieved when other alkyl ether phosphoric acids were used, namely mixed mono- and di-stearyl—1 EO phosphate and predominantly mono $C_{14}$–$C_{15}$ alkyl—3 EO phosphate.

EXAMPLE 17

A mixture was prepared of 1 part of predominantly monoalkyl ($C_{16}$–$C_{18}$) phosphoric acid and 4 parts of petroleum jelly, and then 1.25 parts of the molten mixture were sprayed onto a detergent base powder having the formulation:

| Ingredient | % |
|---|---|
| Sodium alkyl benzene sulphonate | 8.00 |
| Sodium tripolyphosphate | 35.00 |
| Sodium alkaline silicate | 5.40 |
| Sodium sulphate | 14.87 |
| Sodium perborate | 24.00 |
| Sodium carboxymethylcellulose | 1.00 |
| Ethylenediaminetetraacetate | 0.20 |
| Fluorescers, perfume, water, etc | 10.28 |

The resultant product was found to have satisfactory low lather properties, similar to those of a comparative product having a ternary active mixture instead of the alkyl benzene sulphonate alone.

What is claimed is:

1. A detergent composition for fabric washing in water comprising about 1% to about 90% by weight of an anionic or mixed anionic-nonionic detergent active compound, and about 0.05% to about 20% by weight of an alkyl phosphoric acid having the general formula:

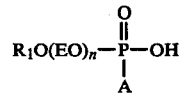

where A is —OH or $R_2O$, n is 0 and $R_1$ and $R_2$ are the same or different $C_{16-22}$ straight or branched chain, saturated or unsaturated alkyl groups, or a salt thereof, and about 0.05% to about 20% by weight of a solid hydrocarbon wax of mineral origin which melts at a temperature of about 20° C. to about 90° C.

2. A detergent composition for fabric washing in water according to claim 1, comprising a polyvalent metal salt of the alkyl phosphoric acid.

3. A detergent composition for fabric washing in water according to claim 1 comprising an alkali metal or ammonium salt of the alkali phosphoric acid.

4. A detergent composition for fabric washing in water according to claim 1 wherein A is —OH.

5. A detergent composition for fabric washing in water according to claim 1 wherein $R_1$ and $R_2$ are $C_{16-18}$ linear saturated alkyl groups.

6. A detergent composition for fabric washing in water according to claim 1 comprising about 0.1% to about 5% by weight of the alkyl phosphoric acid or polyvalent salt thereof.

7. A detergent composition for fabric washing in water according to claim 1 wherein the solid hydrocarbon wax is of mineral origin having a melting point between about 30° C. to about 70° C.

8. A detergent composition for fabric washing in water according to claim 1 wherein the amount of the solid hydrocarbon wax is about 0.5% to about 5% by weight of the composition.

9. A detergent composition for fabric washing in water according to claim 1 wherein the ratio of the alkyl phosphoric acid or salt thereof to the hydrocarbon wax is about 1:20 to about 10:1 parts by weight.

10. A detergent composition for fabric washing in water according to claim 1 wherein the alkyl phosphoric acid or salt thereof and the hydrocarbon wax are in substantially homogeneous admixture in the composition.

11. A detergent composition for fabric washing in water according to claim 1 comprising about 5% to about 50% by weight of an anionic detergent compound.

12. A detergent composition for fabric washing in water according to claim 1 comprising about 5% to about 80% by weight of an organic or inorganic detergency builder.

13. A detergent additive for use in a detergent composition for fabric washing in water according to claim 1 which comprises in substantially homogeneous admixture an alkyl phosphoric acid having the general formula:

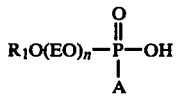

wherein A is —OH or $R_2O$, and n is O and $R_1$ and $R_2$ are the same or different $C_{16-22}$ straight or branched chain, saturated or unsaturated alkyl groups, or a salt thereof, and a solid hydrocarbon wax which melts at a temperature of about 20° C. to about 90° C., the ratio of the alkyl phosphoric acid or salt thereof to the hydrocarbon wax being about 1:20 to about 10:1 parts by weight.

14. A detergent additive according to claim 13 wherein the hydrocarbon wax is of mineral origin having a melting point between about 30° C. and about 70° C.

15. A detergent additive according to claim 13 wherein the ratio of the alkyl phosphoric acid or salt thereof to the hydrocarbon wax is about 1:10 to about 1:1 parts by weight.

16. A detergent additive according to claim 13 comprising a calcium salt of the alkyl phosphoric acid.

17. A detergent additive according to claim 13 wherein A is —OH.

18. A detergent additive according to claim 13 wherein $R_1$ and $R_2$ are $C_{16-18}$ linear saturated alkyl groups.

19. A process for forming a detergent composition for fabric washing in water comprising forming a detergent additive according to claim 13 and admixing the additive with an anionic or mixed anionic-nonionic detergent active compound.

20. A process according to claim 19, wherein the detergent additive is sprayed onto a detergent base powder comprising the detergent active compound.

21. A process according to claim 19, wherein the detergent additive is in granular form and is admixed with a detergent base powder comprising the detergent active compound.

* * * * *